US011745912B2

(12) United States Patent
Richardson

(10) Patent No.: US 11,745,912 B2
(45) Date of Patent: Sep. 5, 2023

(54) BOX AND METHOD OF FOLDING

(71) Applicant: Tonya Richardson, Jacksonville, FL (US)

(72) Inventor: Tonya Richardson, Jacksonville, FL (US)

( * ) Notice: Subject to any disclaimer, the term of this patent is extended or adjusted under 35 U.S.C. 154(b) by 0 days.

(21) Appl. No.: 17/880,403

(22) Filed: Aug. 3, 2022

(65) Prior Publication Data

US 2022/0371770 A1 Nov. 24, 2022

Related U.S. Application Data

(63) Continuation-in-part of application No. 17/844,515, filed on Jun. 20, 2022.

(51) Int. Cl.
*B65D 5/66* (2006.01)
*B65D 5/42* (2006.01)

(52) U.S. Cl.
CPC ..... *B65D 5/66* (2013.01); *B65D 5/4279* (2013.01)

(58) Field of Classification Search
CPC ..... B65D 5/66; B65D 5/4279; B65D 5/0254; B65D 5/2052; B65D 5/10; B65D 5/6608; B65D 5/6638; B65D 5/6658
USPC ... 229/125.08, 131, 152, 155, 156, 185, 231
See application file for complete search history.

(56) References Cited

U.S. PATENT DOCUMENTS

| | | | | |
|---|---|---|---|---|
| 655,939 | A | 8/1900 | Overton | |
| 2,713,965 | A | 7/1955 | Acker | |
| 3,101,882 | A | 8/1963 | Parker | |
| 3,319,869 | A * | 5/1967 | Ostwald | B65D 5/10 229/155 |
| 5,102,382 | A | 4/1992 | Center et al. | |
| 7,159,761 | B2 * | 1/2007 | Abshire | B65D 5/10 229/185 |
| 7,740,163 | B2 * | 6/2010 | Abshire | B65D 5/10 229/185 |
| 9,428,300 | B2 | 8/2016 | Sharp | |

* cited by examiner

*Primary Examiner* — Christopher R Demeree
(74) *Attorney, Agent, or Firm* — Marks Gray, P.A.; Mitchell Ghaneie; Claire Patton

(57) ABSTRACT

An exemplary, nonlimiting embodiment of the present disclosure provides a box, as well as a method of use for the box, which may be opened and closed without substantially damaging the structural integrity of the box. The box comprises a segmental lid, which comprises of a first, second, third, and fourth flap. The first and fourth flaps further comprise a first and second pivotable tab, respectfully. The pivotable tabs are pivotally configurable and are preferably configured to be oriented in substantially opposing directions, relative to one another when the first and fourth flap are disposed in the same plane. The pivotable to allow for the flaps to be disposed in a closed position without damaging the box. The method comprises disposing the flaps into their respectively closed positions such that they may be subsequently re-opened without compromising the structural integrity of the box.

7 Claims, 7 Drawing Sheets

BOX AND METHOD OF FOLDING

CROSS-REFERENCE TO RELATED APPLICATIONS

This application is a continuation-in-part of U.S. patent application Ser. No. 17/844,515, filed on Jun. 20, 2022, which is incorporated herein by reference in its entirety.

FIELD OF THE INVENTION

The subject matter disclosed herein relates to a system comprising a box and a method of opening and closing the box which mitigates structural damage to the box.

BACKGROUND

Shipping and packaging industries frequently use corrugated folding cartons, also commonly referred to as cardboard boxes, to transport goods of varying shapes and sizes. Utilizing corrugated folding cartons which are configured into rectangular prisms has become common practice and provides many efficiencies in the numerous industries. However, one significant drawback to the proliferation of cardboard boxes is their limited service-life.

Cardboard boxes are frequently used as single-use consumable goods. However, cardboard boxes are often utilized by individuals when moving from one residence to another or keeping personal possessions in storage. In such circumstances, as well as numerous others, it is preferrable to extend the service-life of the cardboard box such that the box may endure numerous cycles of being opened and closed without compromising the structural integrity of the box.

Conventional cardboard boxes typically comprise four top and bottom flaps. Folding the flaps in an overlapping configuration is a common method for forming top and bottom surfaces. This overlapping configuration is often preferrable to other methods of forming top and bottom surfaces as such other methods often require adhesive tape or other forms of supplemental reinforcement to secure the flaps in place. However, unfortunately this overlapping configuration requires that at least one flap be distorted as well as one or more adjacent walls be stressed such that they endure inelastic strains that diminish their stability and, consequently, the structural integrity of the box as a whole.

Accordingly, what is needed is a box which allows for its flaps to be closed in an interlocking configuration without compromising the structural integrity of the box during repeated cycles of being closed and opened.

SUMMARY OF THE INVENTION

An exemplary, nonlimiting embodiment of the present disclosure provides a box which may be disposed between a closed and an open configuration without diminishing the structural integrity of the box. The box comprising at least four walls, a segmental lid, and a base. Each wall of the at least four walls is of a uniform height and comprises a top side and a bottom side. The segmental lid comprises a first, second, third, and fourth flap. Each flap comprises an interior and exterior surface. The base provides a substantially flat surface.

The first flap is pivotally attached to a top side of a first wall and is pivotally configurable about the top side of the first wall. The second flap is pivotally attached to a top side of a second wall and is pivotally configurable about the top side of the second wall. The third flap is pivotally attached to a top side of a third wall and is pivotally configurable about the top side of the third wall. The fourth flap is pivotally attached to a top side of a fourth wall and is pivotally configurable about the top side of the fourth wall.

Each flap is pivotally configurable such that they can be disposed in a closed position, an open position, or a partially open position. The box is configured in a closed configuration when each of the flaps are disposed in their respective closed positions. The first and fourth flaps further comprise a first and second pivotable tab, respectively. The first and second pivotable tabs comprise a first and second joint, respectively. The first and second pivotable tabs are preferably oriented in opposing directions. The first pivotable tab is preferably oriented in an upward orientation when the first flap is disposed in its closed position. Each joint is located at a predetermined location. It is preferrable that the joints of each pivotable tab be aligned such that they are colinear when the first and fourth flaps are disposed in their respective open positions.

NUMBER REFERENCES

1—Box
5—Segmental Lid
10—First Flap
10E—First flap exterior surface
101—First flap interior surface
15—First pivotable tab
15A—First joint
20—Second Flap
20E—Second flap exterior surface
201—Second flap interior surface
30—Third flap
30E—Third flap exterior surface
301—Third flap interior surface
40—Fourth flap
40E—Fourth flap exterior surface
401—Fourth flap interior surface
45—Second pivotable tab
45A—Second joint
50—Adjacent Edge
55—Incision
60—Base
A—Linear axis extension (of first joint 15A)
B—Linear axis extension (of second joint 45A)

DETAILED DESCRIPTION

Figure 9:
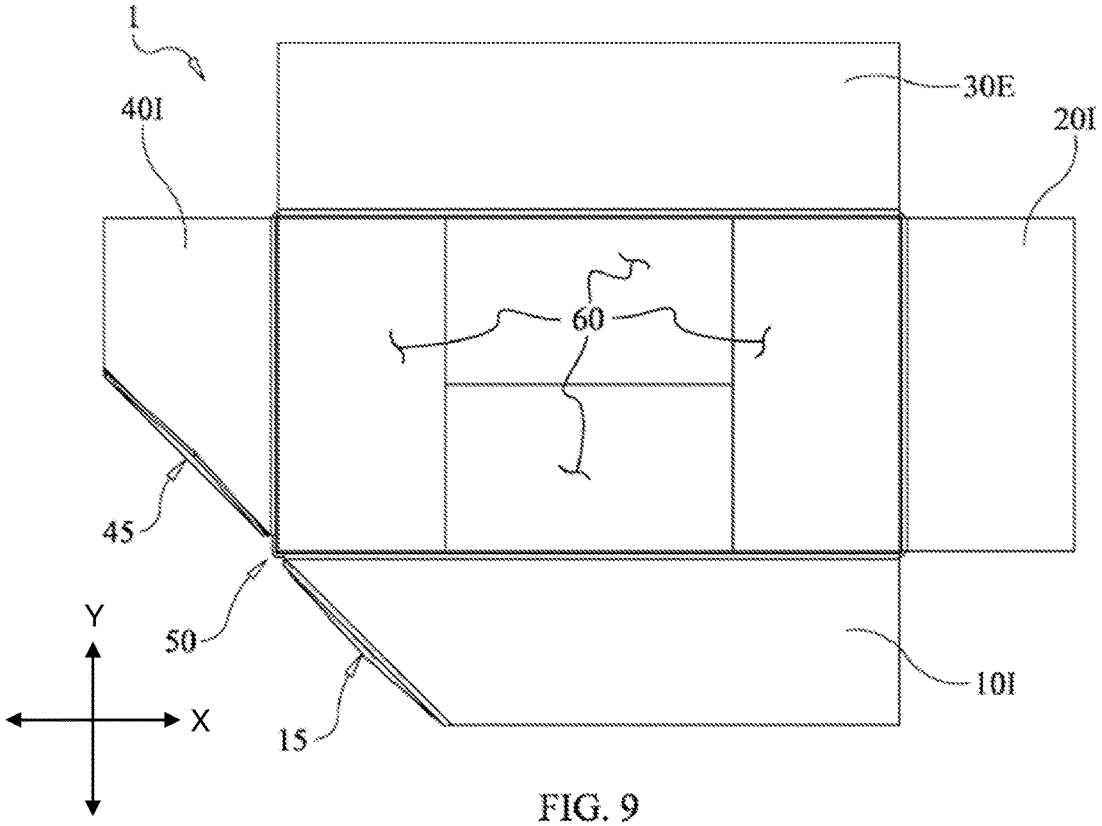
FIG. 9 depicts a top view of the box as configured in FIG. 1 with a base comprising a plurality of flaps disposed in a closed configuration.
Figure 10:
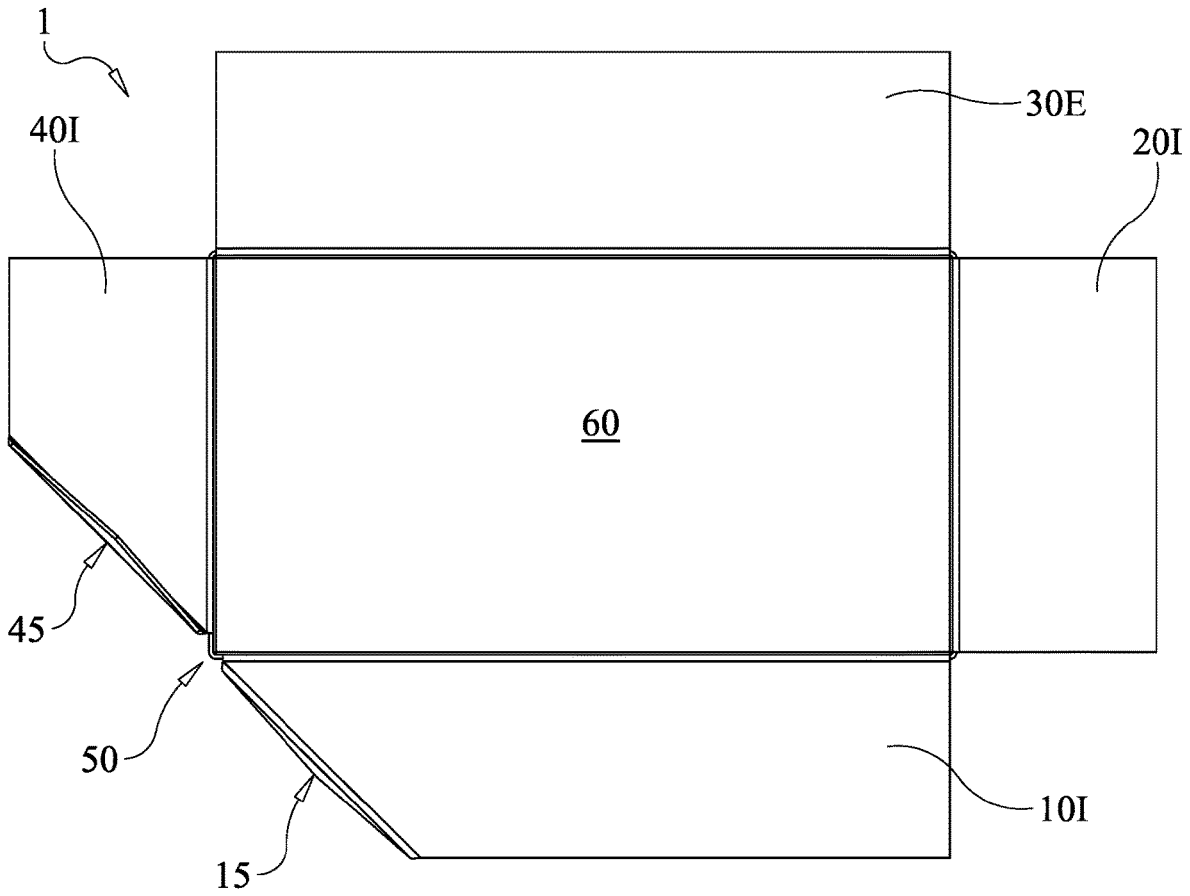
FIG. 10 depicts an alternative top view of the box as configured in FIG. 1 with a base comprising a unitary surface.

An exemplary, nonlimiting embodiment of the present disclosure provides a box 1 which may be disposed between a closed and an open configuration without compromising the structural integrity of the box 1. The box 1 is constructed of one or more rigid or semi-rigid materials. It is preferable that the box 1 be primarily constructed of a single material, but it is anticipated that the box 1 may be constructed of more than one material. The box 1 comprises at least four walls, a segmental lid 5, and a base 60. The at least four walls comprise a first wall, a second wall, a third wall, and a fourth wall. The at least four walls are of a substantially uniform height, and each respectively comprises a top side and a bottom side. The base 60 is attached to the at least four walls and is substantially orthogonal to each of the walls, as shown in FIGS. 9 and 10. It is preferrable, but not required, that the base be substantially flat and orthogonal with respect to the at least four walls.

Figure 2:
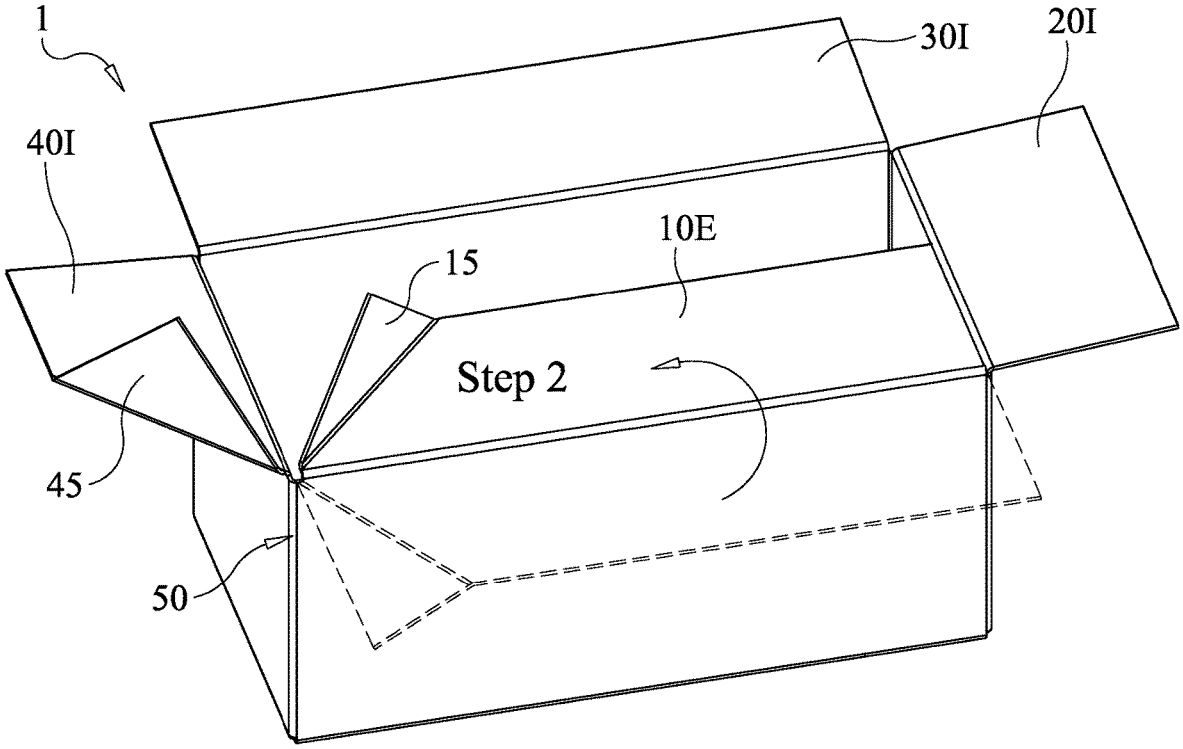
FIG. 2 depicts a perspective view of an exemplary, nonlimiting embodiment of the box configured in a partially open configuration, wherein a first flap is pivotally disposed about a top side of a first wall to its closed position.
Figure 3:
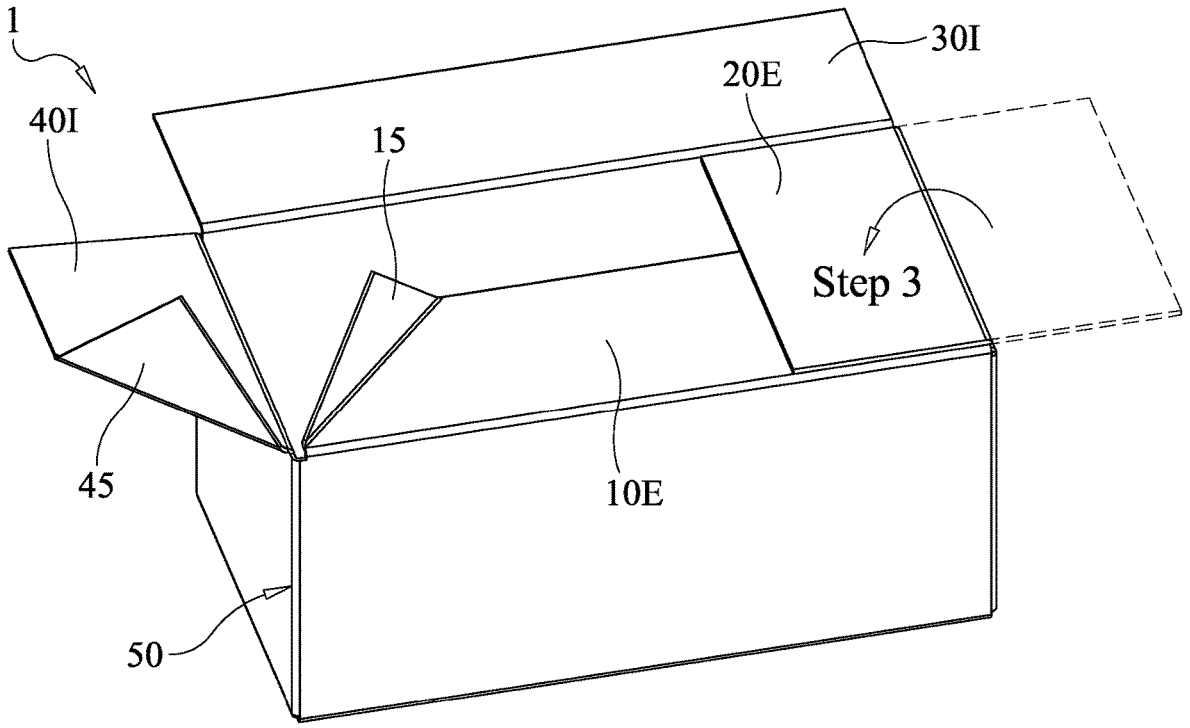
FIG. 3 depicts a perspective view of an exemplary, nonlimiting embodiment of the box configured in a partially open configuration, wherein the first flap is pivotally disposed about the top side of the first wall such that it is oriented in the closed position and a second flap is pivotally disposed about a top side of a second wall such that it is oriented in a closed position and partially overlaps the first flap.
Figure 4:
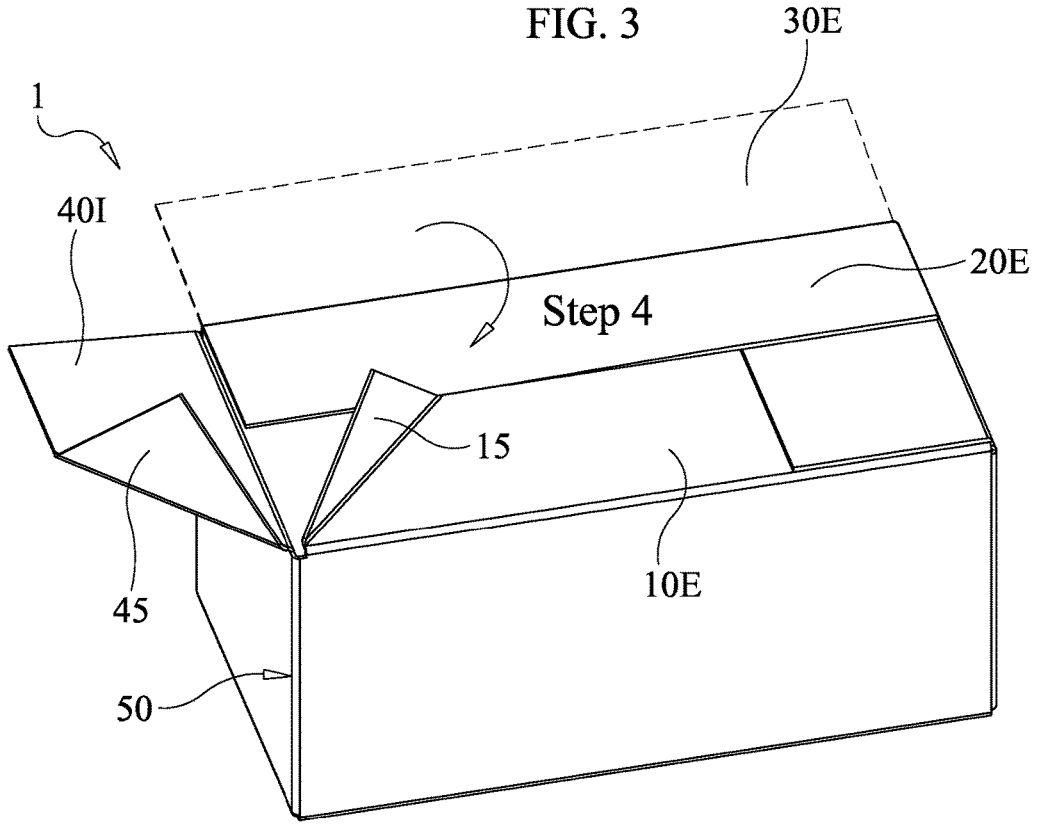
FIG. 4 depicts a perspective view of an exemplary, nonlimiting embodiment of the box configured in a partially open configuration, wherein the first flap is pivotally disposed about the top side of the first wall such that it is oriented in the closed position, the second flap is pivotally disposed about the top side of the second wall such that it is oriented in the closed position and partially overlaps the first flap, and a third flap is pivotally disposed about a top side of a third wall such that it is oriented in a closed position and partially overlaps the second flap.
Figure 5:
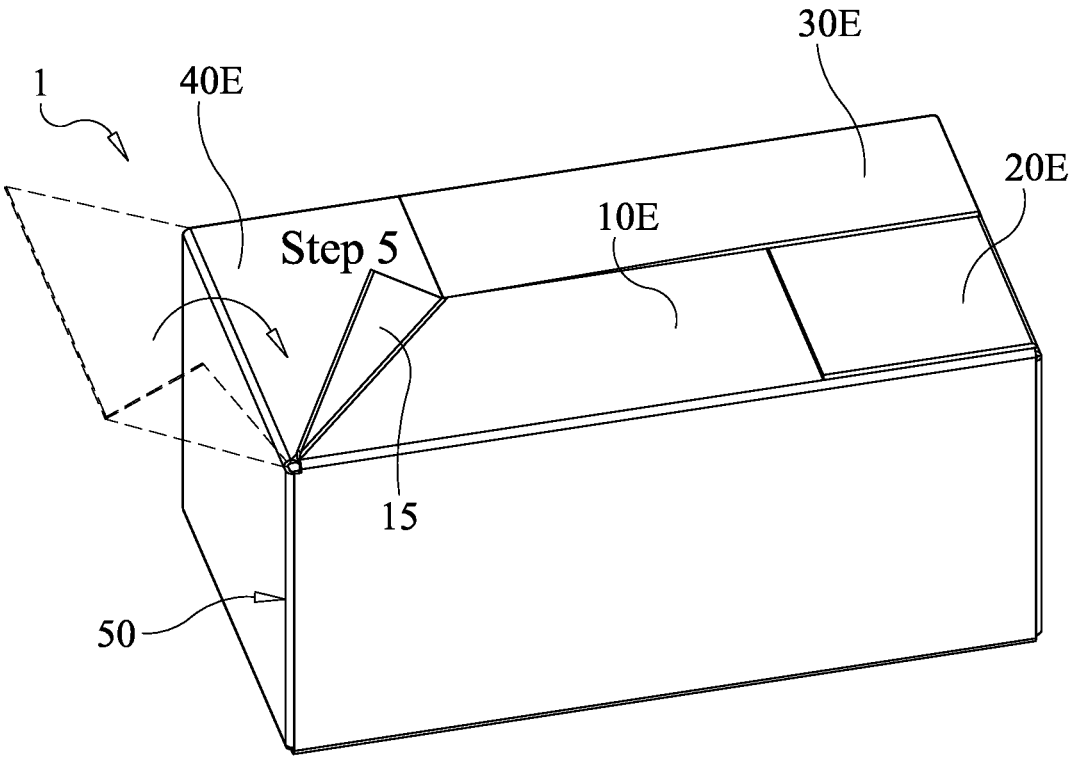
FIG. 5 depicts a perspective view of an exemplary, nonlimiting embodiment of the box configured in a partially open configuration, wherein the first flap is pivotally disposed about the top side of the first wall such that it is oriented in the closed position, the second flap is pivotally disposed about the top side of the second wall such that it is oriented in the closed position and partially overlaps the first flap, the third flap is pivotally disposed about the top side of the third wall such that it is oriented in the closed position and partially overlaps the second flap, and a fourth flap is pivotally disposed about a top side of a fourth wall such that it is oriented in a closed position and partially overlaps the third flap.

The segmental lid 5 comprises a first flap 10, a second flap 20, a third flap 30, and a fourth flap 40. Each flap of the four flaps 10, 20, 30, 40 comprise an interior surface 101, 201, 301, 401 (respectively), an exterior surface 10E, 20E, 30E, 40E (respectively), and a thickness. Each of the flaps 10, 20, 30, 40 further comprise three free edges and one bounded edge. The interior surface and exterior surface of each flap 10, 20, 30, 40 are substantially vertically offset from each other by a distance equal to the thickness of their respective flap. As shown in FIG. 2, the first flap 10 is pivotally attached along its bounded edge to a top side of the first wall and is pivotally configurable about the top side of the first wall. As shown in FIG. 3, the second flap 20 is pivotally attached along its bounded edge to a top side of the second wall and is pivotally configurable about the top side of the second wall. As shown in FIG. 4, the third flap 30 is pivotally attached along its bounded edge to a top side of the third wall and is pivotally configurable about the top side of the third wall. As shown in FIG. 5, the fourth flap 40 is pivotally attached along its bounded edge to a top side of the fourth wall and is pivotally configurable about the top side of the fourth wall.

Figure 1:
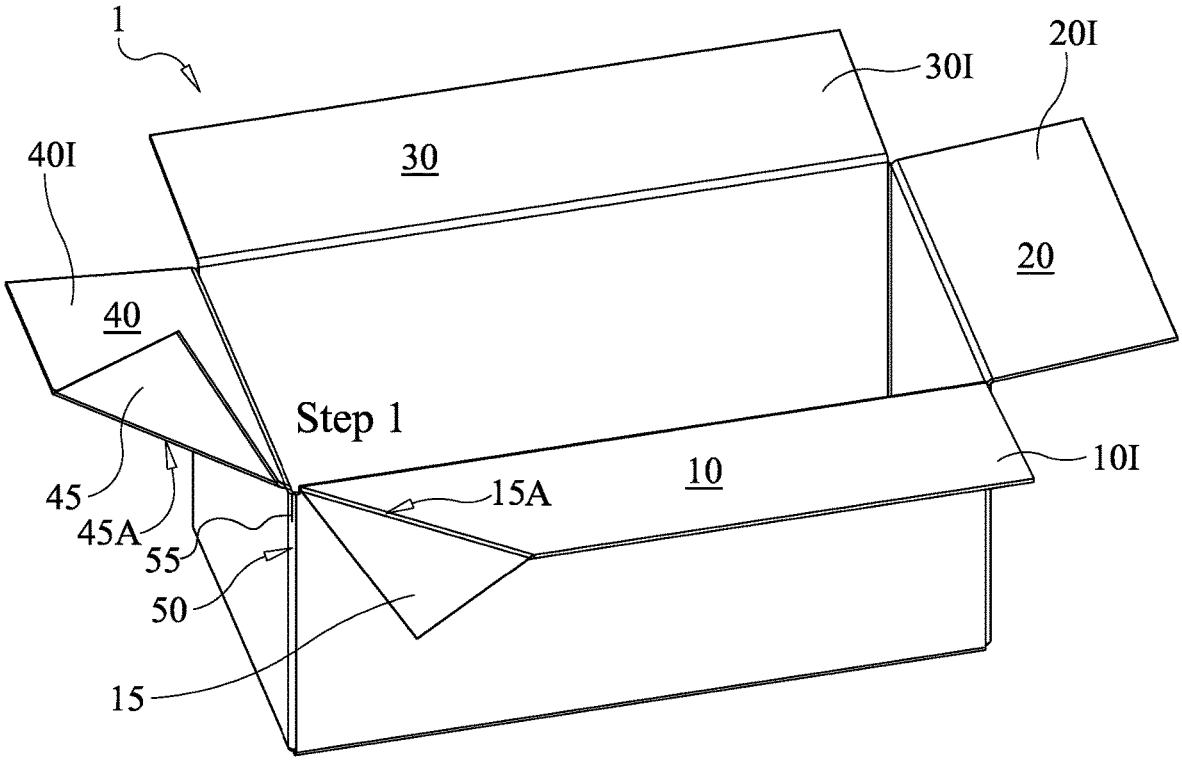
FIG. 1 depicts a perspective view of an exemplary embodiment of a box disposed in an open configuration.
Figure 6:
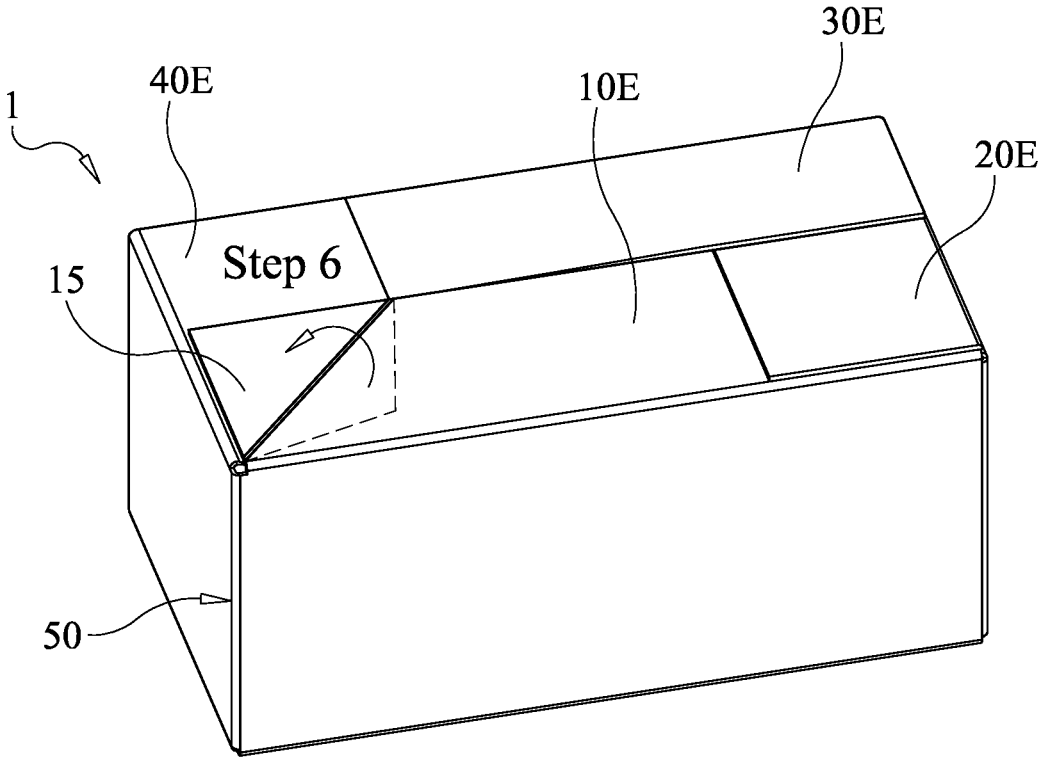
FIG. 6 a perspective view of an exemplary, nonlimiting embodiment of the box configured in a fully closed configuration.
Figure 7:
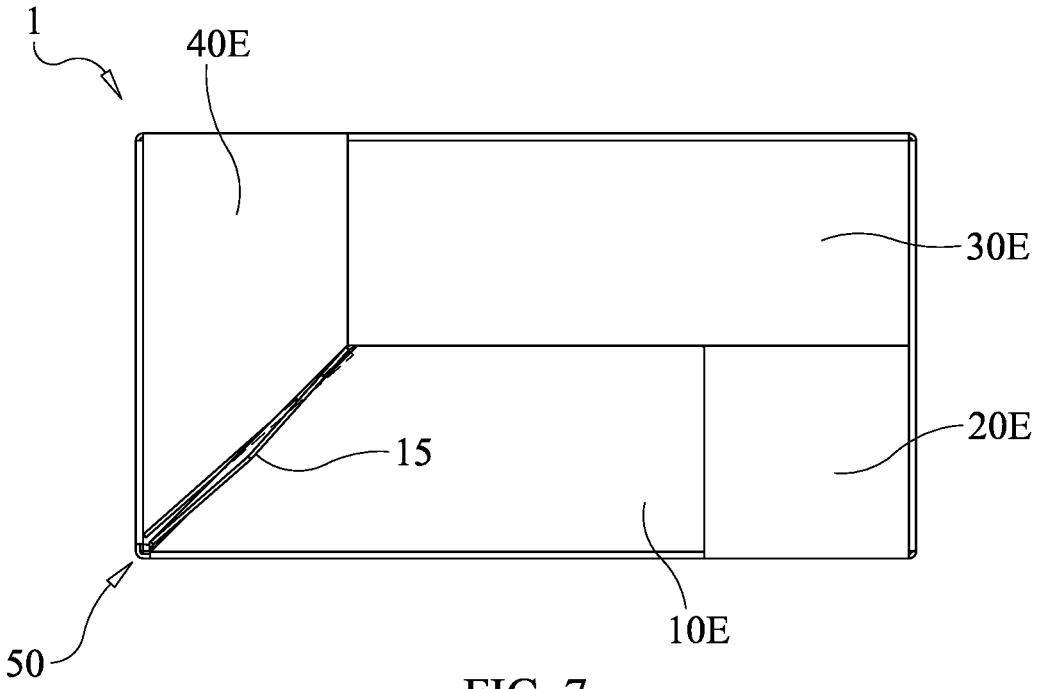
FIG. 7 depicts a top view of the box as configured in FIG. 5.
Figure 8:
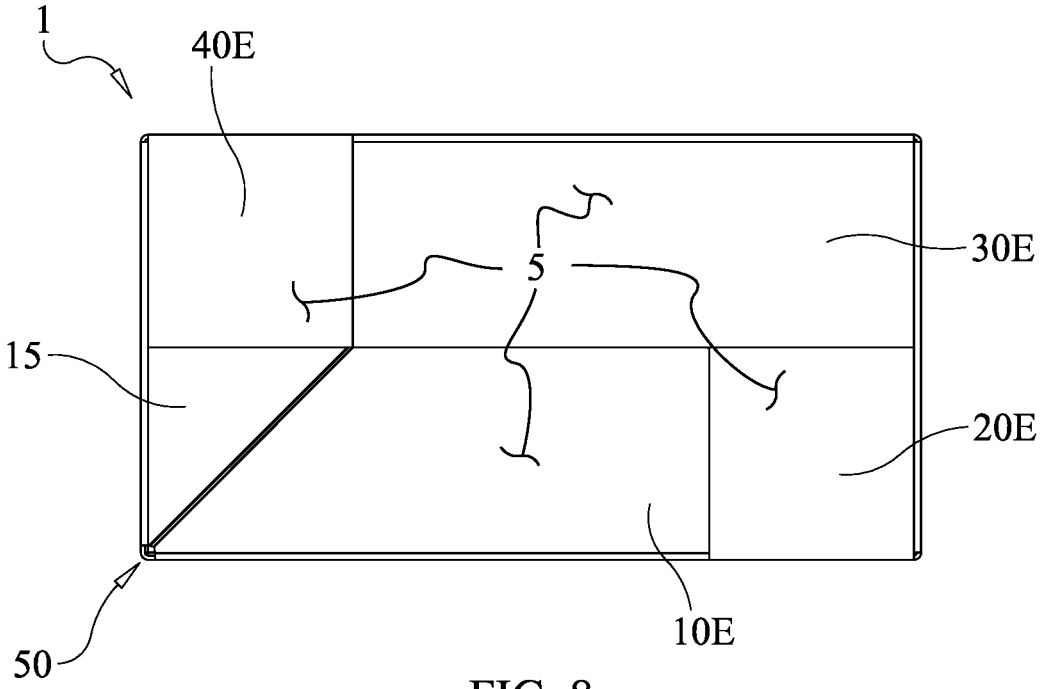
FIG. 8 depicts a top view of the box as configured in FIG. 6.

Each of the four flaps 10, 20, 30, 40 are pivotally configurable such that they can each be disposed in a closed position, a partially open position, or an open position. The box 1 may be configured in a closed configuration, partially open configuration, or an open configuration. The box 1 is configured in the closed configuration when all of the flaps 10, 20, 30, 40 are disposed in their respective closed positions, as shown in FIG. 6. The box 1 is configured in the open position when all of the flaps 10, 20, 30, 40 are configured in their respective open positions, as shown in FIG. 1. The box is configured in the partially open configuration when one or more of the flaps 10, 20, 30, 40 are not all concurrently configured in their respective closed positions or concurrently configured in their respective open positions.

The closed position of each flap 10, 20, 30, 40 is defined as the flap being oriented in a plane substantially orthogonal to the wall it is pivotally attached to wherein its interior surface is vertically offset from the base 60 by a distance less than the distance which the exterior surface of the respective flap is vertically offset from the base 60. The open position of each flap 10, 20, 30, 40 is defined as the flap being oriented in a plane substantially orthogonal to the wall it is pivotally attached to wherein its exterior surface is vertically offset from the base 60 by a distance less than the distance which the interior surface of the respective flap is vertically offset from the base 60. The partially open position of each flap is defined as the flap being oriented in a plane that is not substantially orthogonal to the wall it is pivotally attached to.

The first flap 10 further comprises a first pivotable tab 15 and the fourth flap 40 further comprises a second pivotable tab 45. The first pivotable tab 15 is bound by a first joint 15A as well as the portions of the two adjacent free edges of the first flap 10 that are bisected by the first joint 15A. The second pivotable tab 45 is bound by a second joint 45A as well as the portions of the two adjacent free edges of the fourth flap 40 that are bisected by the second joint 45A. The first and second pivotable tabs 15, 45 are oriented in substantially opposing directions when their corresponding flaps 10, 40 are oriented in substantially parallel planes, as shown in FIG. 1. The first pivotable tab 15 is preferably oriented in a downward orientation that is substantially orthogonal to the plane that the first flap 10 is oriented in when the first flap 10 is disposed in its open position, as shown in FIG. 1. The second pivotable tab 45 is preferably oriented in an upward orientation that is substantially orthogonal to the plane that the fourth flap 40 is oriented in when the fourth flap 40 is disposed in its open position, as shown in FIG. 1.

It is anticipated that the first and second joints 15A, 45A may be provided at a predetermined location on their respective flaps 10, 40. It is further anticipated that the joints 15A, 45A may be visually or tactilely identified on their respective flaps 10, 40. As an example, it is anticipated that each joint 15A, 45A may be marked on one or both surfaces of their respective flaps or may be formed by a predetermined linear indentation in one or both surfaces of their respective flaps. In another example, it is anticipated that the first and second joints 15A, 45A may be identified by a predefined discontinuity of one of the surfaces of the flaps 10, 40 which consequently promotes the rotation of the pivotable tab 15, 45 about its respective joint 15A, 45A in a predetermined direction.

The first wall and the fourth wall are attached to one another along an adjacent edge 50, as shown in FIG. 1. The adjacent edge 50 comprises a top end and a bottom end. It is anticipated that the adjacent edge 50 may be configured to have an incision 55. The incision 55 is preferably located at the top of the adjacent edge 50 such that it extends from the top end towards the bottom end for a predetermined distance. The predetermined distance ranges from about an eighth of an inch to about one inch (not shown). The predetermined distance that the incision 55 spans is dependent on the rigidity of the material which the box 1 is constructed. The incision 55 at the adjacent edge 50 is configured to provide a portion at the top of the adjacent edge where the first wall and the fourth wall are detached. The incision 55 provides the first and fourth walls additional translational and rotational flexibility to mitigate mechanical stresses imparted on the first and fourth flaps and walls which they are pivotally attached to during the closing and opening of the segmental lid 5.

A method of use for the box 1, for sequential folding of the flaps in an interlocking configuration, comprises pivotally disposing the four flaps 10, 20, 30, 40 to their respective open positions, pivotally disposing the first pivotable tab 15 about the first joint 15A such that it is oriented in a downward orientation, pivotally disposing the second pivotable tab 45 about the second joint 45A such that it is oriented in an upward orientation (Step 1, FIG. 1), pivotally disposing the first flap 10 about the top side of the first wall to its closed position (Step 2, FIG. 2), pivotally disposing the second flap 20 about the top side of the second wall to its closed position such that the second flap 20 partially overlaps the first flap exterior surface 10E (Step 3, FIG. 3), pivotally disposing the third flap 30 about the top side of the third wall to its closed position such that the third flap 30 partially overlaps the second flap exterior surface 20E (Step 4, FIG. 4), pivotally disposing the fourth flap 40 about the top side of the fourth wall to its closed position such that the fourth flap 40 partially overlaps the third flap exterior surface 30E and the second pivotable tab 45 is disposed beneath the first flap interior surface 101 (Step 5, FIG. 5), and pivotally disposing the first pivotable tab 15 about the first joint 15A such that it is oriented in a substantially parallel plane as the first flap 10 in its closed position (Step 6, FIG. 6).

Figure 9A:
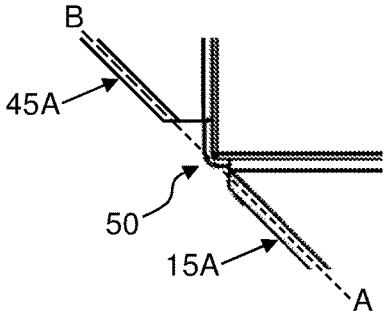
FIG. 9A depicts an alternative embodiment of FIG. 9B where the first joint and the second joint are aligned colinear relative to one another.
Figure 9B:
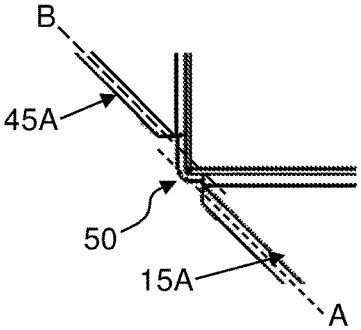
FIG. 9B depicts an enlarged view of the top end of the adjacent edge of FIG. 9 (with first pivotable tab 15 and second pivotable tab 45 removed for clarity) where the first joint and the second joint are aligned noncolinear and parallel relative to one another.
Figure 9C:
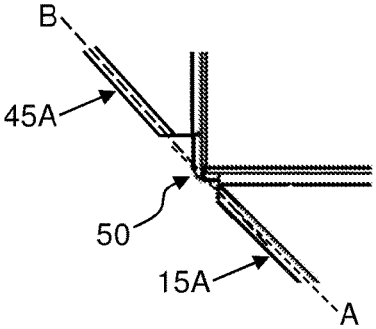
FIG. 9C depicts an alternative embodiment of FIG. 9B where the first joint and the second joint are aligned noncolinear relative to one another such that linear axis extensions of each joint intersect each other.
Figure 11:
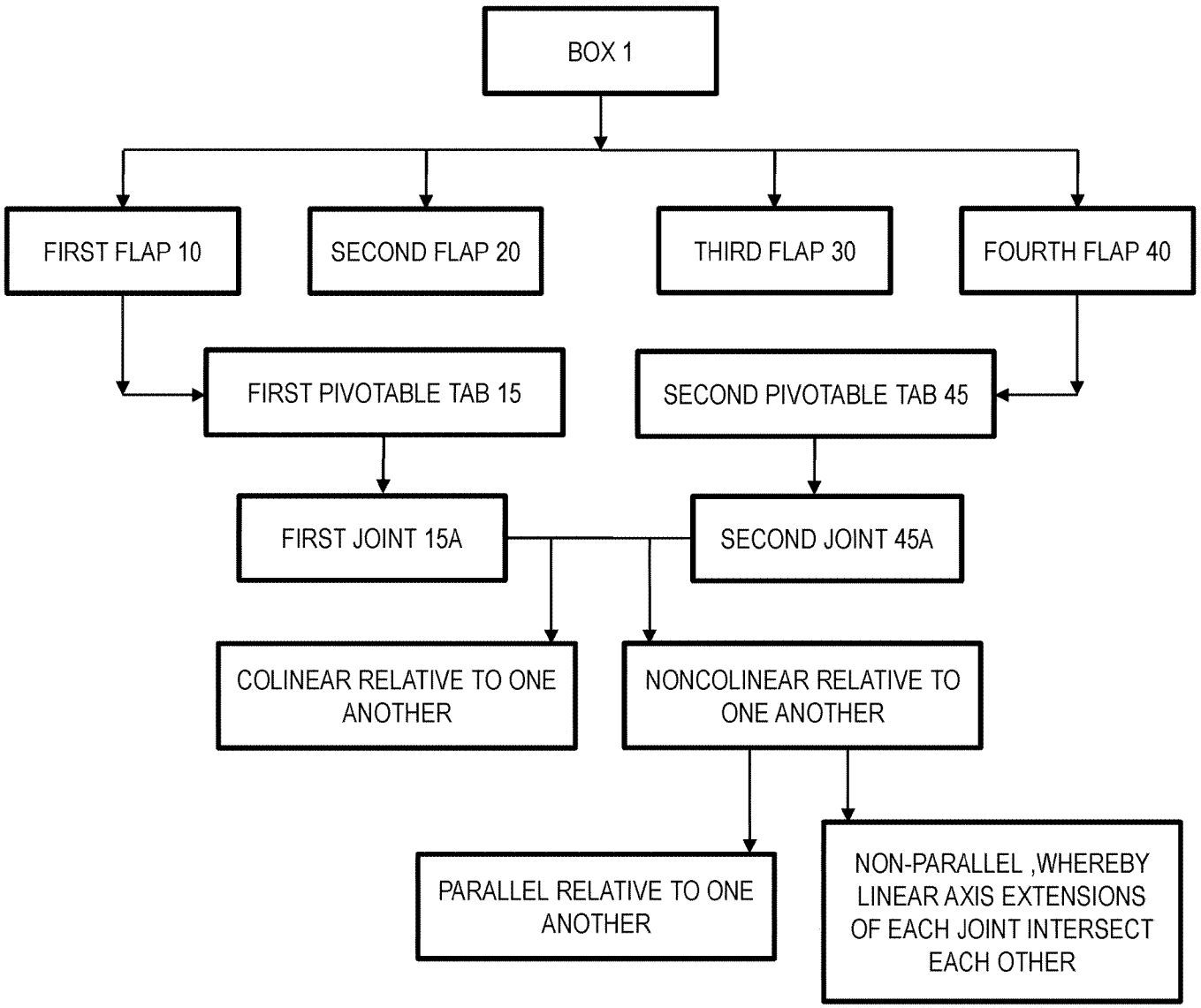
FIG. 11 depicts a schematic flow chart of the box, the four flaps, the two tabs, and the two joints; the two joints being aligned colinear or noncolinear, the noncolinear alignment being either parallel or such that linear axis extensions of each joint intersect each other.

The first joint 15A and the second joint 45A are disposed at locations and aligned relative to each other to facilitate folding of the flaps in an interlocking configuration, to avoid interference of second joint 45A with first joint 15 A as it pivots pass first joint 15A in Step 5, as described above. The first and second joints 15A, 45A, are disposed such that the proximal ends of each of the joints are disposed substantially adjacent to each other and adjacent to the top of the adjacent edge 50. As shown in FIGS. 9A-C and as shown schematically in FIG. 11, when the first flap 10 and the fourth flap 40 are disposed in their respective open positions (the first flap and the fourth flap oriented in parallel planes relative to the X-Y plane in FIG. 9), the first and second joints 15A, 45A, may be oriented colinear or noncolinear relative to each other, and if noncolinear, the joints may be parallel or non-parallel relative to each other. As shown in FIGS. 9A-C, the first joint 15A has a linear axis extension A, and the second joint 45A has a linear axis B. As shown in FIG. 9A, in one embodiment, the first joint 15A and the second joint 45A are disposed at locations as to have colinear alignment when the first flap 10 and the fourth flap 40 are disposed in their respective open positions. As shown in FIG. 9B, in another embodiment, the first joint 15A and the second joint 45A are disposed at locations as to have noncolinear parallel alignment relative to each other when the first and fourth flaps 15A, 45A are disposed in their respective open positions. As shown in FIG. 9C, in another embodiment, the first joint 15A and the second joint 45A are disposed at locations as to have noncolinear non-parallel alignment relative to each other when the first and fourth flaps 15A, 45A are disposed in their respective open positions. In such a noncolinear alignment, the linear axis extension A of the first joint 15A and the linear axis extension B of the second joint 45A intersect each other.

While the embodiments of the invention have been disclosed, certain modifications may be made by those skilled in the art to modify the invention without departing from the spirit of the invention.

What is claimed:

1. A box comprising:

a. at least four walls;

wherein the at least four walls comprise a first wall, a second wall, a third wall, and a fourth wall;

wherein each wall of the at least four walls comprises a top side;

wherein the first and fourth walls are attached to one another along an adjacent edge;

b. a segmental lid;

wherein the segmental lid comprises a first flap, a second flap, a third flap, and a fourth flap;

wherein each of the flaps comprise an interior surface and an exterior surface;

wherein each of the flaps comprise three free edges and one fixed edge;

wherein the first flap is pivotally attached to the top side of the first wall along its respective fixed edge;

wherein the second flap is pivotally attached to the top side of the second wall along its respective fixed edge;

wherein the third flap is pivotally attached to the top side of the third wall along its respective fixed edge;

wherein the fourth flap is pivotally attached to the top side of the fourth wall along its respective fixed edge;

wherein the first flap comprises a first pivotable tab;

wherein the first pivotable tab comprises a first joint;

wherein the first pivotable tab is pivotally configurable about the first joint;

wherein the fourth flap comprises a second pivotable tab;

wherein the second pivotable tab comprises a second joint;

wherein the second pivotable tab is pivotally configurable about the second joint;

wherein the first joint and the second joint are disposed such that the proximal ends of each of the joints are disposed adjacent to each other and adjacent to the top of the adjacent edge;

wherein a linear axis extension of the first joint and a linear axis extension of the second joint are colinear relative to each other when the first flap and fourth flap are each respectively disposed in their open positions;

c. a base; and wherein the base is attached to each wall of the at least four walls.

2. The box as described in claim 1, wherein the adjacent edge further comprises an incision located at its top end.

3. A box comprising:

a. at least four walls;

wherein the at least four walls comprise a first wall, a second wall, a third wall, and a fourth wall;

wherein each wall of the at least four walls comprises a top side;

wherein the first and fourth walls are attached to one another along an adjacent edge;

wherein the adjacent edge comprises an incision located near it top end;

b. a segmental lid;

wherein the segmental lid comprises a first flap, a second flap, a third flap, and a fourth flap;

wherein each of the flaps comprise an interior surface and an exterior surface;

wherein each of the flaps comprise three free edges and one fixed edge;

wherein the first flap is pivotally attached to the top side of the first wall along its respective fixed edge;

wherein the second flap is pivotally attached to the top side of the second wall along its respective fixed edge;

wherein the third flap is pivotally attached to the top side of the third wall along its respective fixed edge;

wherein the fourth flap is pivotally attached to the top side of the fourth wall along its respective fixed edge;

wherein the first flap comprises a first pivotable tab;

wherein the first pivotable tab comprises a first joint;

wherein the first pivotable tab is pivotally configurable about the first joint;

wherein the fourth flap comprises a second pivotable tab;

wherein the second pivotable tab comprises a second joint;

wherein the second pivotable tab is pivotally configurable about the second joint;

wherein the first joint and the second joint are disposed such that the proximal ends of each of the joints are disposed adjacent to each other and adjacent to the top of the adjacent edge;

wherein the first joint and the second joint are parallel non-colinear relative to one another when the first flap and fourth flap are each respectively disposed in their open positions;

c. a base; and wherein the base is attached to each wall of the at least four walls.

4. The box as described in claim 3, wherein the adjacent edge further comprises an incision located at its top end.

5. The box as described in claim 3, wherein the first joint and the second joint are parallel relative to one another when the first flap and fourth flap are each respectively disposed in their open positions.

6. The box as described in claim 3, wherein the first joint and the second joint intersect one another when the first flap and fourth flap are each respectively disposed in their open positions.

7. A box comprising:

a. at least four walls;

wherein the at least four walls comprise a first wall, a second wall, a third wall, and a fourth wall;

wherein each wall of the at least four walls comprises a top side;

wherein the first and fourth walls are attached to one another along an adjacent edge;

wherein the adjacent edge comprises an incision located at its top end;

wherein the incision is configured to provide a portion at the top of the adjacent edge whereby the first wall and the fourth wall are detached;

b. a segmental lid;

wherein the segmental lid comprises a first flap, a second flap, a third flap, and a fourth flap;

wherein each of the flaps comprise an interior surface and an exterior surface;

wherein each of the flaps comprise three free edges and one fixed edge;

wherein the first flap is pivotally attached to the top side of the first wall along its respective fixed edge;

wherein the second flap is pivotally attached to the top side of the second wall along its respective fixed edge;

wherein the third flap is pivotally attached to the top side of the third wall along its respective fixed edge;

wherein the fourth flap is pivotally attached to the top side of the fourth wall along its respective fixed edge;

wherein the first flap comprises a first pivotable tab;

wherein the first pivotable tab comprises a first joint;

wherein the first pivotable tab is pivotally configurable about the first joint;

wherein the fourth flap comprises a second pivotable tab;

wherein the second pivotable tab comprises a second joint;

wherein the second pivotable tab is pivotally configurable about the second joint;

c. a base; and wherein the base is attached to each wall of the at least four walls.

* * * * *